US010306999B2

(12) United States Patent
Smith

(10) Patent No.: US 10,306,999 B2
(45) Date of Patent: Jun. 4, 2019

(54) TWO PIECE COLLAPSIBLE DISPLAY HUTCH

(71) Applicant: Sonoco Development, Inc., Hartsville, SC (US)

(72) Inventor: Andre C. Smith, Westmont, IL (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 16/179,517

(22) Filed: Nov. 2, 2018

(65) Prior Publication Data

US 2019/0069694 A1 Mar. 7, 2019

Related U.S. Application Data

(63) Continuation of application No. 15/813,323, filed on Nov. 15, 2017, now Pat. No. 10,159,362, which is a continuation of application No. 15/267,751, filed on Sep. 16, 2016, now Pat. No. 9,844,282.

(60) Provisional application No. 62/219,940, filed on Sep. 17, 2015.

(51) Int. Cl.

| | |
|---|---|
| ***A47F 5/10*** | (2006.01) |
| ***A47F 5/11*** | (2006.01) |
| ***A47B 43/02*** | (2006.01) |
| ***A47B 55/06*** | (2006.01) |

(52) U.S. Cl.

CPC ..... *A47F 5/116* (2013.01); *A47B 43/02* (2013.01); *A47B 55/06* (2013.01); *A47F 5/10* (2013.01); *A47F 5/112* (2013.01)

(58) Field of Classification Search

CPC .. A47F 5/116; A47F 5/10; A47F 5/112; A47F 5/11; A47F 5/114; A47F 5/118; A47F 5/0025; A47F 5/0043; A47B 43/02; A47B 55/06; A47B 45/00; A47B 47/06; A47B 43/00; A47B 47/00

USPC ..... 211/135, 72, 73, 149, 186, 126.16, 195, 211/132.1, 70.1; 248/174, 152; 229/108.1, 120.31, 120.15, 120.24, 229/120.26; 206/736; 312/258, 259

See application file for complete search history.

(56) References Cited

U.S. PATENT DOCUMENTS

| | | | | | |
|---|---|---|---|---|---|
| 1,925,673 | A * | 9/1933 | Potter | A47F 5/116 | 108/100 |
| 1,926,793 | A * | 9/1933 | Richards | A47F 5/116 | 108/100 |
| 1,964,880 | A * | 7/1934 | Katz | A47F 5/116 | 108/100 |
| 2,062,165 | A * | 11/1936 | Davidson | A47F 5/112 | 211/135 |
| 2,277,807 | A * | 3/1942 | Whitestone | A47F 5/116 | 108/99 |
| 2,666,531 | A * | 1/1954 | Anderson, Jr. | A47F 5/112 | 108/99 |

(Continued)

*Primary Examiner* — Jennifer E. Novosad

(74) *Attorney, Agent, or Firm* — Miller, Matthias & Hull LLP

(57) ABSTRACT

A two piece, easy-to-assemble hutch for shipping and displaying items is provided. The hutch comprises two laterally opposing, hinged sidewalls, one or more elongated horizontal front panels, a rear wall and shelves made of two halves. The hutch is moveable between a first position in which each shelf is folded up against itself and a second position in which each shelf forms a substantially planar load supporting surface.

15 Claims, 8 Drawing Sheets

(56) References Cited

U.S. PATENT DOCUMENTS 2,801,754 A * 8/1957 Dorfman ..... A47F 5/112 108/100
3,438,508 A * 4/1969 Kuns ..... A47F 5/116 211/126.16
4,506,790 A * 3/1985 Muscari ..... A47F 5/116 108/180
4,519,319 A * 5/1985 Howlett ..... A47F 5/116 108/180
4,570,805 A * 2/1986 Smith ..... A47F 5/116 211/132.1
4,646,922 A * 3/1987 Smith ..... A47F 5/116 211/132.1
4,991,804 A * 2/1991 Iannucci ..... A47F 5/116 206/45.24
5,193,466 A * 3/1993 Eder ..... A47F 5/116 108/166
5,315,936 A * 5/1994 Smith ..... A47F 5/116 108/165
5,443,168 A * 8/1995 Dyment ..... A47F 5/116 211/149
5,678,492 A * 10/1997 Pinkstone ..... A47B 43/02 108/165
5,706,959 A * 1/1998 Smith ..... A47F 5/0018 108/165
5,826,732 A * 10/1998 Ragsdale ..... A47F 5/116 211/149
6,098,820 A * 8/2000 Smith ..... A47F 5/116 211/132.1
6,612,669 B2 * 9/2003 Grueneberg ..... A47B 43/02 108/165
6,752,280 B2 * 6/2004 Dye ..... A47F 5/116 108/162
7,007,615 B2 * 3/2006 Grueneberg ..... A47B 43/02 108/165
7,677,433 B2 * 3/2010 Little ..... B65D 5/526 206/744
7,703,864 B2 4/2010 Moser
7,882,966 B2 * 2/2011 Field ..... A47F 5/116 211/72
7,905,365 B2 * 3/2011 Virvo ..... A47F 5/116 211/73
8,157,112 B2 * 4/2012 Bojie ..... A47F 5/11 211/135
8,485,370 B2 * 7/2013 Dewhurst ..... A47F 5/116 211/135
8,875,908 B2 * 11/2014 L'Hotel ..... A47F 5/116 211/135
9,198,508 B1 * 12/2015 Kufel ..... A47F 5/116
9,474,389 B2 * 10/2016 Pfeifer ..... A47F 5/11
9,844,282 B2 * 12/2017 Smith ..... A47F 5/116
10,159,362 B2 * 12/2018 Smith ..... A47F 5/116
2003/0160015 A1 * 8/2003 Broerman ..... A47F 5/116 211/149
2004/0148825 A1 * 8/2004 Myers ..... A47F 5/116 40/124
2008/0169339 A1 * 7/2008 Moser ..... B65D 5/5213 229/108.1
2008/0265726 A1 * 10/2008 Sheffer ..... A47B 47/06 312/259
2010/0006529 A1 * 1/2010 Groff ..... A47F 5/116 211/186
2010/0025344 A1 * 2/2010 Virvo ..... A47F 5/116 211/59.2
2011/0080074 A1 * 4/2011 Farkas ..... B65D 5/722 312/122
2014/0014606 A1 * 1/2014 Mestres Armengol ..... A47F 5/116 211/135
2015/0068998 A1 * 3/2015 Smith ..... A47F 5/116 211/135
2015/0136720 A1 * 5/2015 Miller ..... A47F 5/112 211/135
2016/0066711 A1 * 3/2016 Mestres Armengol ..... A47F 5/116 211/135
2017/0079449 A1 * 3/2017 Smith ..... A47F 5/116

* cited by examiner (Hutch)

(Hutch Body Blank)

(Hutch Spine Blank)

TWO PIECE COLLAPSIBLE DISPLAY HUTCH

CROSS REFERENCE TO RELATED APPLICATION

This application is a continuation of U.S. application Ser. No. 15/813,323, filed Nov. 15, 2017, now pending, which is a continuation of U.S. application Ser. No. 15/267,751, filed Sep. 16, 2016 and claiming priority from U.S. Provisional Application No. 62/219,940, filed Sep. 17, 2015, now U.S. Pat. No. 9,844,282. Each patent application identified above is incorporated here by reference in its entirety to provide continuity of disclosure.

BACKGROUND OF THE INVENTION

Field of the Invention

This invention patent relates to a display hutch. More particularly, this invention relates to a display hutch that can be pre-assembled, shipped flat, and then easily set up before being loaded with items.

Description of the Related Art

Corrugated hutches, or hutch-like containers made primarily of corrugated board, can be used to ship items and then display the items in a retail setting. A need exists for an inexpensive corrugated hutch that can be pre-assembled at the source, shipped flat, and then easily erected before being loaded with items. The present disclosure addresses this need.

BRIEF SUMMARY OF THE INVENTION

The present disclosure relates to a collapsible, easy to assemble hutch.

In one aspect the hutch is formed from two blanks and comprises two laterally opposing, hinged sidewalls, elongated horizontal front panels, a rear wall and shelves. Each sidewall comprises a front sidewall panel and a rear sidewall panel hingedly connected to each other along a vertical sidewall fold line. The front panels have laterally opposing ends and extend between the sidewalls. Each end is connected to a front wall panel along a fold line. The rear wall comprises two rear wall half panels. Each rear wall half panel is hingedly connected to a rear sidewall panel. Each shelf extends between and is supported by one of the front panels and the rear wall, and comprises a front shelf panel, a rear shelf panel, a front facing panel hingedly affixed along a fold line to the front shelf panel and having a front facing surface affixed to one of the horizontal front panels, and a rear facing panel hingedly affixed to the rear shelf panel along a fold line and having a rear facing surface affixed to the rear wall.

The hutch is moveable between a first position in which the front shelf panel and the rear shelf panel of each shelf are positioned in substantially flat, abutting relationship, and a second position in which the front shelf panel and the rear shelf panel of each shelf form a substantially planar load supporting shelf bottom.

BRIEF DESCRIPTION OF THE DRAWINGS

FIG. 4 is a front perspective view of a spine in an initial stage of pre-assembly.

FIG. 5 is a front perspective view of the spine of FIG. 4 in a later stage of pre-assembly.

FIG. 6 is a front perspective view of the spine of FIG. 5 in a later stage of pre-assembly.

FIG. 7 is a rear perspective view of the spine of FIG. 5 shown just before being affixed to a body blank.

FIG. 8 is a rear perspective view of the spine of FIG. 5 after it has been affixed to the body blank.

FIG. 9 is a rear perspective view of the structure of FIG. 8 in a later stage of pre-assembly.

FIG. 10 is a front perspective view of a pre-assembled hutch shown in its "flat" condition prior to final assembly (set up).

DETAILED DESCRIPTION OF THE INVENTION

Figure 1:
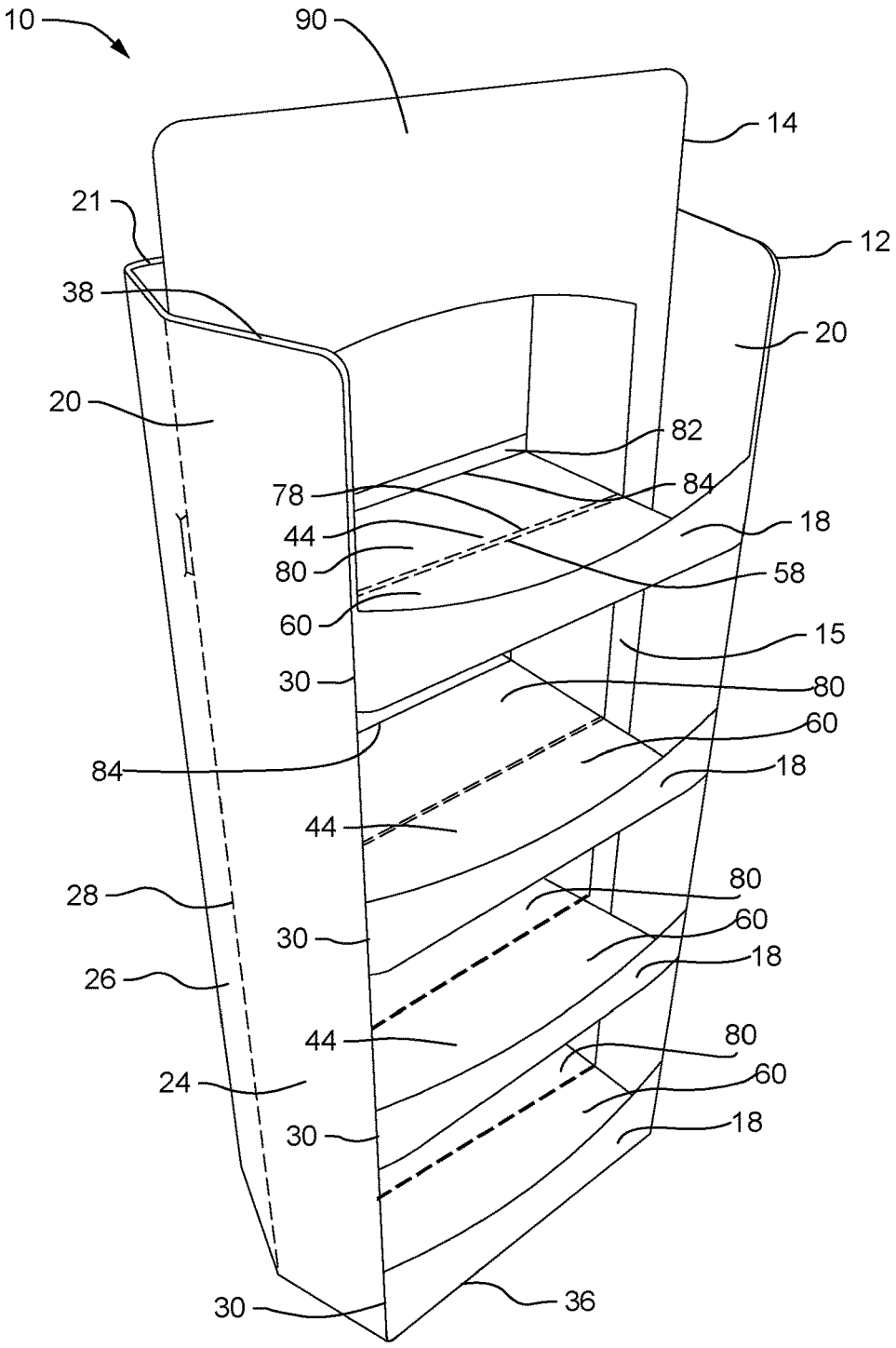
FIG. 1 is a front perspective view of a hutch according to the disclosure.

While this invention may be embodied in many forms, there is shown in the drawings and will herein be described in detail one or more embodiments with the understanding that this disclosure is to be considered an exemplification of the principles of the invention and is not intended to limit the invention to the illustrated embodiments.

As will be appreciated, terms such as "horizontal," "vertical," "left," "right," "up," "down," "top," "bottom," "front", "back", "rear", etc., either used as nouns, adjectives or adverbs (e.g. "horizontally, "upwardly," etc.), refer in this description to the orientation of the structure of the hutch as it is illustrated in the figures when that figure faces the reader. Such terms are not intended to limit the invention to a particular orientation. The terms "integral", "integrally connected" or "integrally joined" when used to describe the relationship between two or more structures means that the structures are comprised of a single piece of material.

Referring now to FIG. 1, the invention is a collapsible corrugated hutch 10 comprising a body 12 and a spine 14, each made from a single die cut blank. In the assembled hutch 10 shown in FIG. 1, the spine 14 is slidably positioned within the body 12. That is, the spine 14 can slide vertically with respect to the body 12 so that the hutch 10 can be converted from a substantially flat position for storing and shipping to a three-dimensional display configuration. From the flat position, as the spine 14 slides vertically with respect to the body 12, the body opens up to form a three dimensional outer structure, while parts of the spine 14 spread out to form a three-dimensional inner structure comprising multiple shelves upon which merchandise can be displayed.

Still referring to FIG. 1, the hutch 10 comprises one or more front panels 18, two laterally opposing hinged sidewalls 20, a rear wall 21 and shelves 44.

The one or more front panels 18 extend between and are connected at either lateral end to the two laterally opposing front sidewall panels 24 along front fold lines 30. The front panels 18 are attached to one or more front facing panels 62 (obscured by the front panels 18 in FIG. 1) to support of the shelves 44.

Each hinged sidewall 20 comprises a front sidewall panel 24 and a back sidewall panel 26 integrally connected along a vertical sidewall fold line 28.

The rear wall 21 may be a single panel hingedly connected to a sidewall 20, but preferably is formed from two rear wall half panels 22. The rear wall half panels 22 are attached to and support one or more rear facing panels 82 (at least one of which can be seen in FIG. 1) of the shelves 44.

The shelves 44 extend between and are supported by the front panels 18 and the rear wall 21. Each shelf 44 comprises front and rear shelf flaps 56, 76 which form the load supporting bottoms of the shelves, and front and rear facing panels 62, 82. The front and rear shelf flaps 56, 76 are hingedly affixed to front and rear panels 48, 50 respectively. The front and rear facing panels 62, 82 are hingedly affixed to the front and rear shelf flaps 56, 76 respectively.

Figure 2:
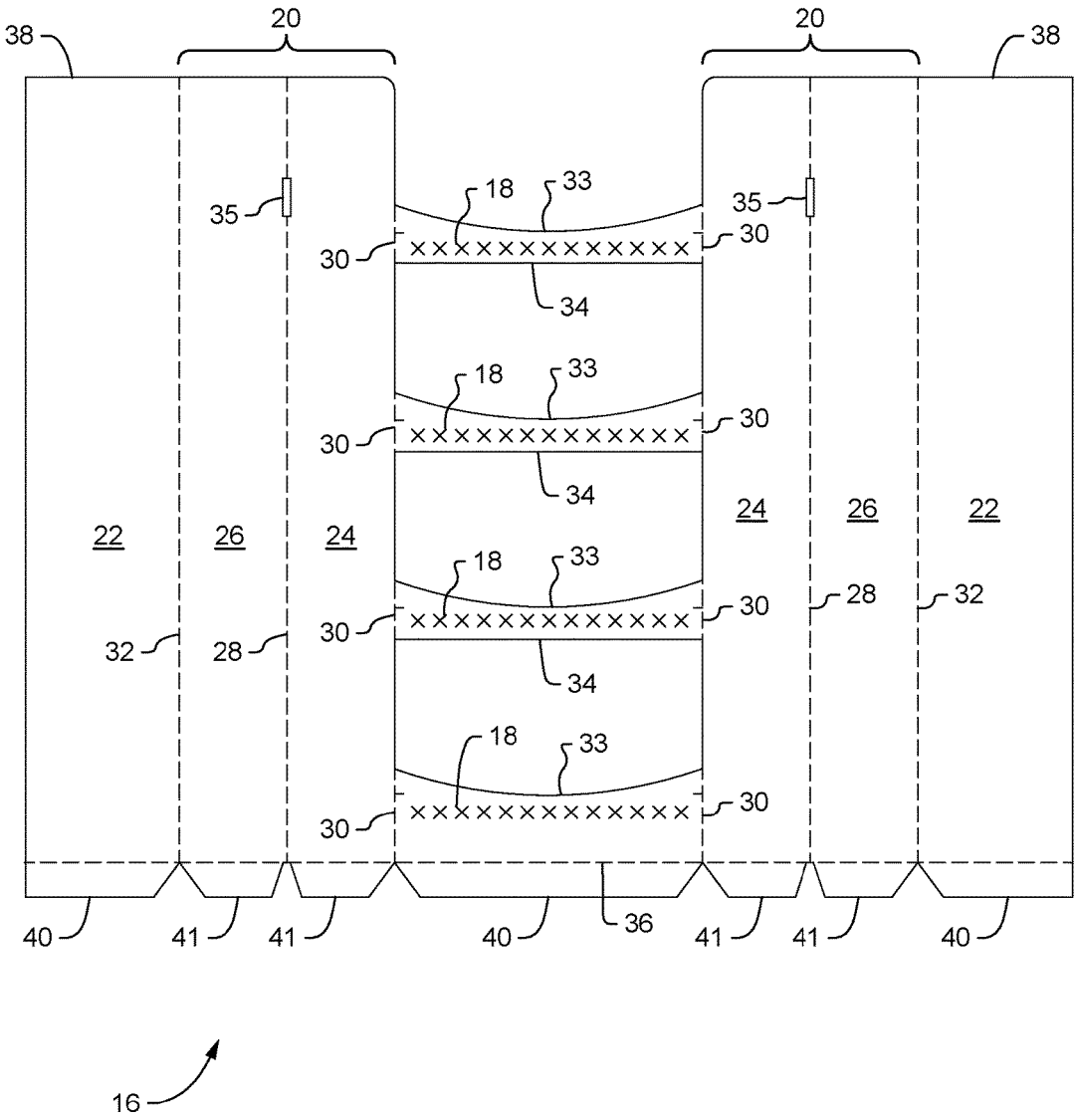
FIG. 2 is a rear view of a first blank used to make the body of the hutch of FIG. 1.

FIG. 2 is a rear view of a first blank 16 used to make the body 12 of the hutch 10 of FIG. 1. The body 12 is made from a first (body) blank 16, preferably made of corrugated board, and comprises at least five and preferably six vertically oriented panels and one or more horizontally oriented panels. The vertically oriented panels comprise the two hinged sidewalls 20 and either one full rear wall panel 21 or two rear wall half panels 22. The horizontally oriented panels are the front panels 18.

Each folding sidewall 20 comprises a front sidewall panel 24 and a back sidewall panel 26 connected along a vertical sidewall fold line 28. Preferably the total width of each pair of front sidewall panel 24 and back sidewall panel 26 exceeds the total depth of the shelves 44 so that each sidewall 20 forms a slight angle in the assembled hutch 10 as shown in FIG. 1.

The front panels 18 extend between and are connected at either end to the opposing front sidewall panels 24 along left and right vertical front fold lines 30. Each front panel 18 may have a free top edge 33 and a free bottom edge 34, although it is preferred that the bottommost front panel 18 extend down to the base 36 of the hutch 10 and be hingedly attached to a bottom flap 40 that folds under the base 36.

Each back sidewall panel 26 is connected along one vertical edge to its corresponding front sidewall panel 24 by a vertical sidewall fold line 28 and on the other vertical edge to a rear wall half panel 22 along a rear vertical fold line 32. The vertical sidewall fold lines 28 and rear fold lines 32 preferably extend from the base 36 to the top edge 38 of the body 12.

Bottom flaps 40 may be hingedly attached to the rear wall half panels 22 and other bottom flaps 41 may be hingedly attached to the sidewalls 20 along the base 36. The bottom flaps 40, 41 are intended to be folded inwardly to help stabilize the base 36. A pair of slots 35 may be formed in the body blank 16 along the vertical sidewall fold lines 28. These slots 35 may be configured to receive outwardly extending tabs 88 located on the sides of the spine 14 to lock the hutch 10 into its final assembled position.

Figure 3:
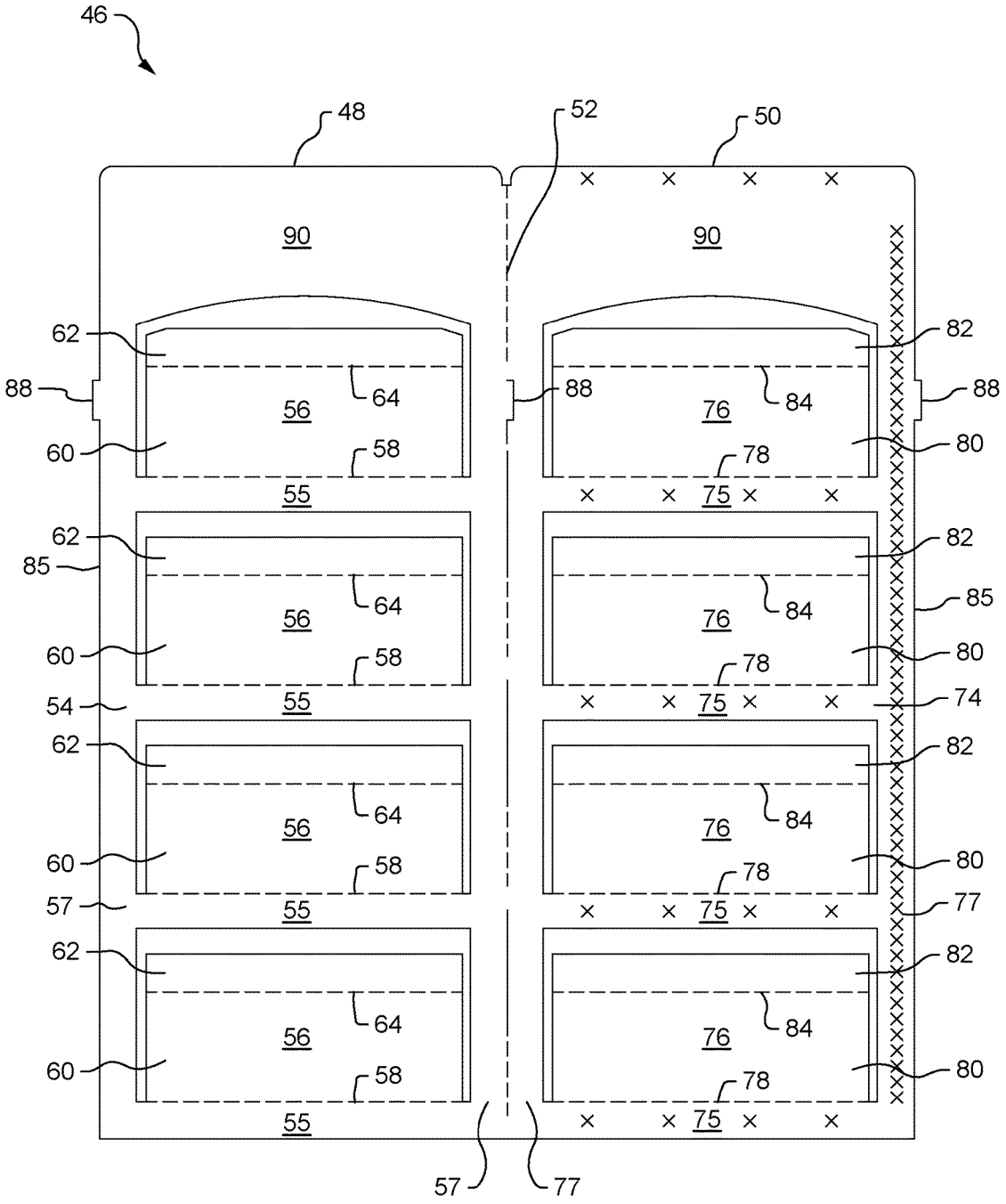
FIG. 3 is a view of a second blank used to make the spine of the hutch of FIG. 1.

FIG. 3 is a view of a second blank 46 used to make the spine 14 of the hutch 10 of FIG. 1. The second blank 46 preferably is made of corrugated board. The second (spine) blank 46 comprises a front panel 48 and a rear panel 50 integrally connected by a vertical spine fold line 52. When folded together the front panel 48 and the rear panel 50 form a frame 15 having a double thickness of corrugated board or of whatever material the spine blank 46 is made. The shelves 44 are hingedly attached to the frame 15. The shelves 44 are suspended from and within the frame 15.

The front panel 48 comprises a front frame 54 and one or more front shelf flaps 56 attached to and suspended within the front frame 54. The front frame 54 is a ladder-like structure and comprises a front header board member 90 located at the top of the front frame 54, a pair of vertical members 57 extending downward from either laterally spaced side of the header board 90, and one or more elongated horizontal members 55 extending between the vertical members 57.

Each front shelf flap 56 comprises a front shelf panel 60 and a front facing panel 62. Each front shelf panel 60 is hingedly and rotatably attached to the front frame 54 and, more particularly, to an elongated horizontal member 55, along a horizontal front shelf fold line 58. Each front facing panel 62 is hingedly connected along a front facing panel fold line 64 to a front shelf panel 60. In addition, the front shelf flaps 56 may be affixed to the front frame 54 along scored or perforated lines which must be broken during pre-assembly.

Preferably the height of each front facing panel 62 does not exceed the height of the corresponding front panel 18 to which it will be attached so that the front facing panels 62 are hidden behind the front panels 18 is the final assembled hutch 10.

Similarly, the rear panel 50 comprises a rear frame 74 and one or more rear shelf flaps 76 attached to and suspended within the rear frame 74. Like the front frame 54, the rear frame 74 is a ladder-like structure and comprises a rear header board member 90 located at the top of the rear frame 74, a pair of vertical members 77 extending downward from either laterally spaced side of the header board 90, and one or more elongated horizontal members 75 extending between the vertical members 77.

Similar to the front shelf flaps 56, each rear shelf flap 76 comprises a rear shelf panel 80 and a rear facing panel. Each rear shelf panel 80 is hingedly and rotatably attached to the rear frame 74 and, more particularly, to an elongated horizontal member 75, along a horizontal rear shelf flap fold line 78. Each rear facing panel is hingedly connected along a rear facing panel fold line 84 to a rear shelf panel 80. In addition, the rear shelf flaps 76 may be affixed to the rear frame 74 along scored or perforated lines which must be broken during pre-assembly.

The front and rear panels 48, 50 may further comprise integrally formed tabs 88 extending laterally from the free side edges 85 of the blank 46. Another tab 88 may be die cut into the spine blank 46 and extend from the vertical spine fold line 52. These tabs 88 are positioned so that they fit into slots 35 located in the hutch body along vertical sidewall fold lines 28 during final set up.

Pre-Assembly

Pre-assembly as used herein refers to the process of assembling the two components of the hutch 10, i.e., the body 12 and the spine 14, wherein the pre-assembled hutch 10 is in a flat ("unopened") configuration, suitable for storage or for delivery to a customer. The hutch 10 may be pre-assembled as follows:

1. Taking a spine blank 46, apply glue to the front facing areas of the horizontal members 75, the outer vertical member 77 and the header portion 90 of the rear panel 50 as indicted by the "X's" in FIG. 3. Alternatively, glue may be applied to various rear facing areas of the horizontal members 55, or to any areas of the front panels 48 or rear panels 50 that enable the front panels 48 and rear panels 50 to be glued together.

Figure 4:
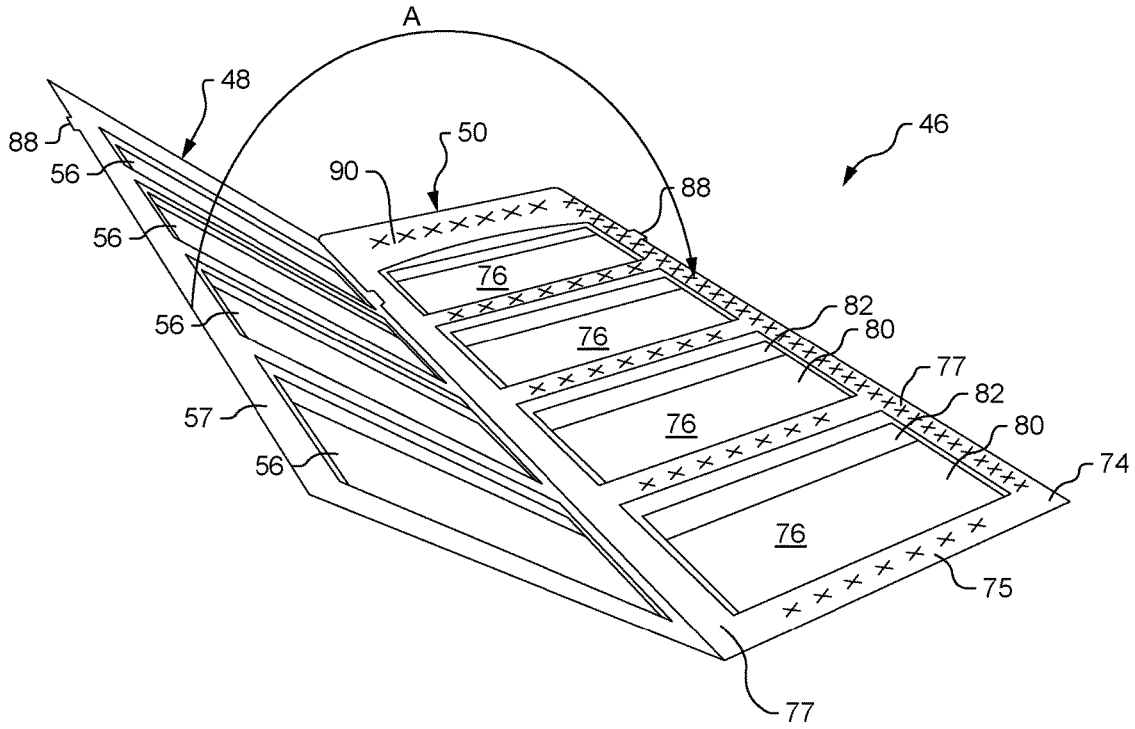
FIGS. 4-10 show how to pre-assemble the hutch of FIG. 1.
Figure 5:
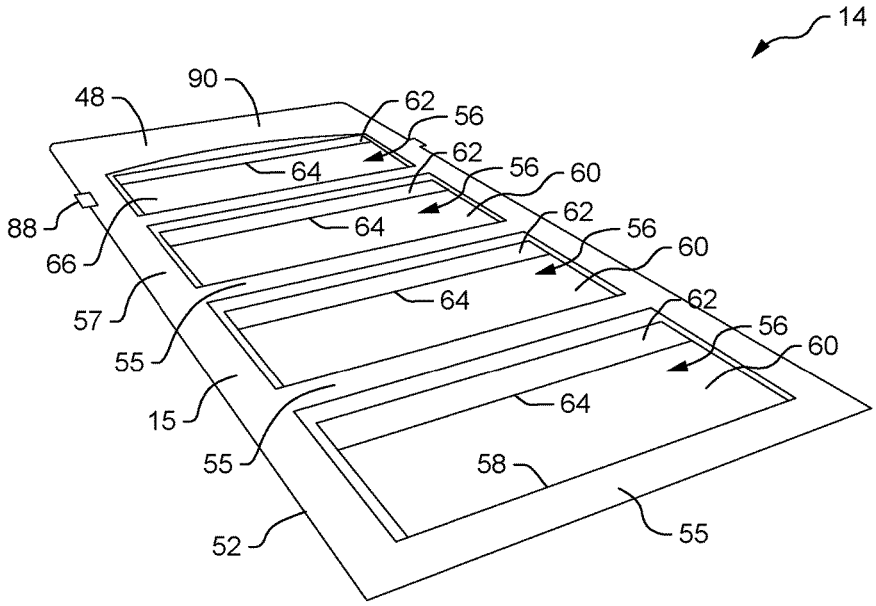

2. Fold the front panel 48 over onto the rear panel 50 as indicated by arrow A in FIG. 4 to obtain the assembled double thickness spine 14 shown in FIG. 5.

Figure 6:
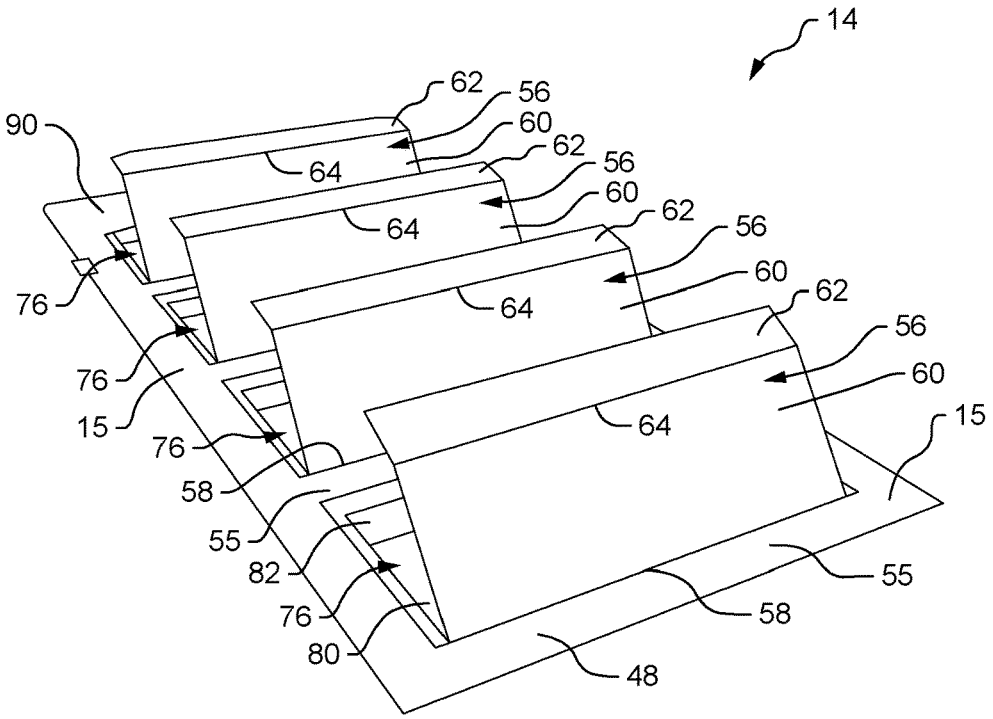

3. If desired, pre-break the shelf scores on the sides of the hutch spine 14 as shown in FIG. 6 before the next pre-assembly step.

4. Taking the body blank 16, apply glue to the rear facing surfaces of the horizontal front panels 18 as indicated by the "X's" in FIG. 2.

Figure 7:
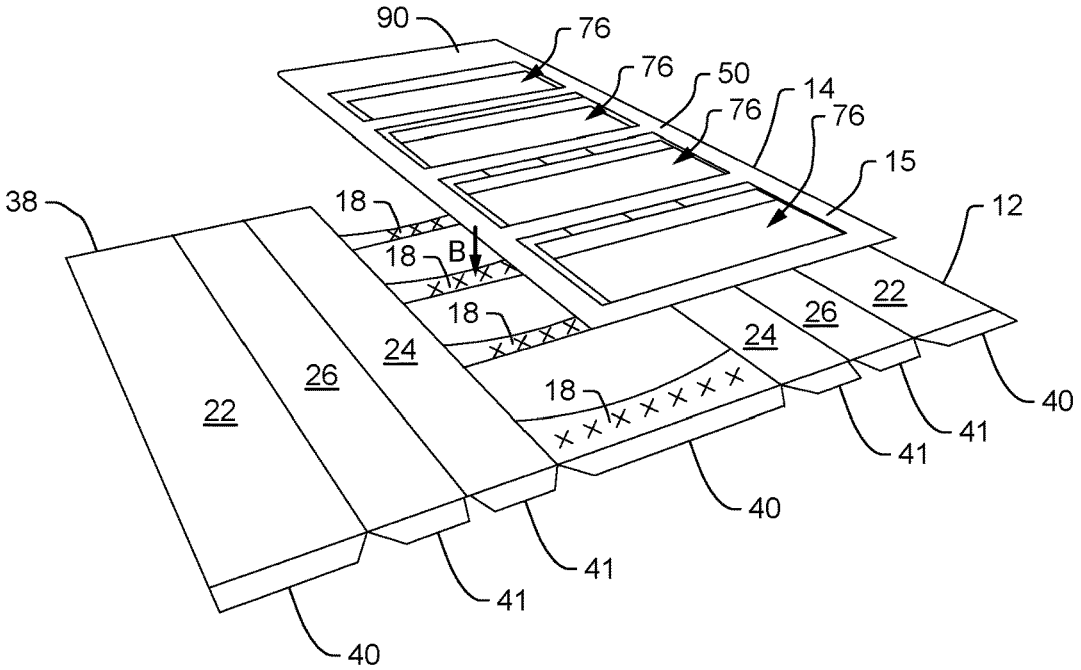
Figure 8:
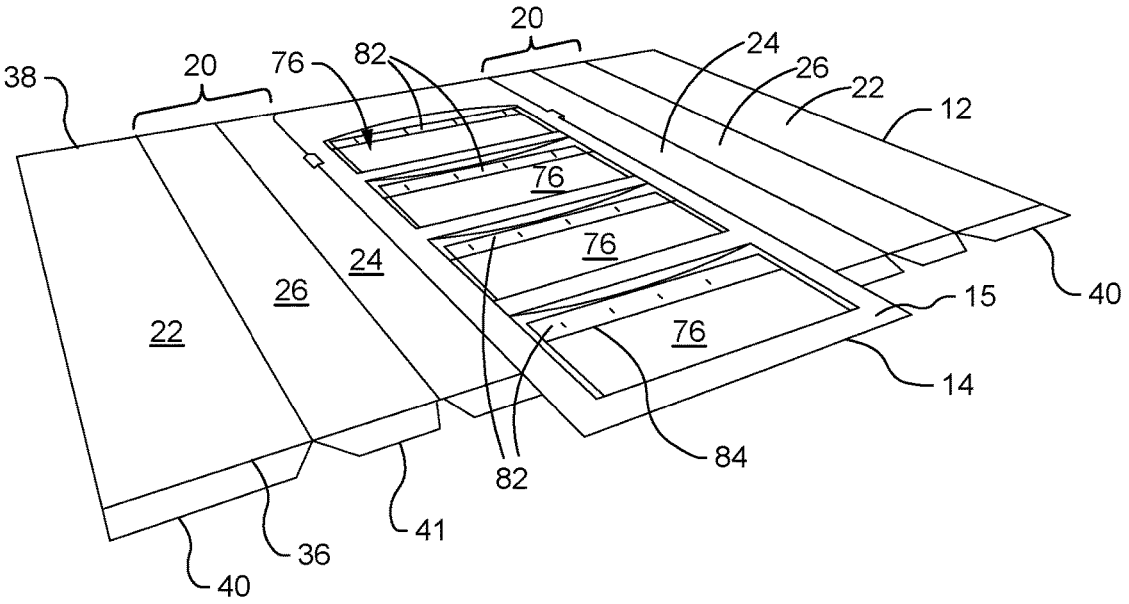

5. Position the assembled spine 14 from Step 2 or 3 onto the rear facing surface of the body blank 16 as indicated by the arrow B in FIG. 7 so that the shelf front facing panels 62 adhere to the body front panels 18 to obtain the configuration shown in FIG. 8. (FIG. 7 is a rear perspective view of the partially pre-assembled hutch 10.)

6. Apply glue to the rear facing surfaces of the rear facing panels 82 as indicted by the areas of the spine 14 marked with "I's" in FIG. 8.

Figure 9:
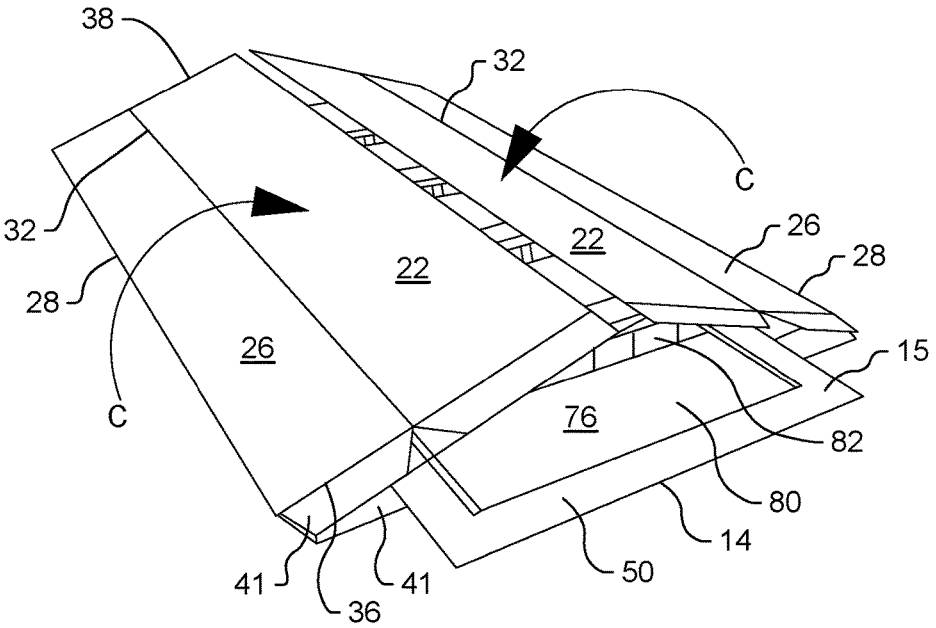

7. Fold the sidewalls 20 and rear wall half panels 22 backwards along sidewall fold lines 28 as indicated by the arrows C in FIG. 9 so that the rear wall half panels 22 adhere to the rear facing panels 82. The flattened, pre-assembled hutch 10 is ready for shipping.

Figure 10:
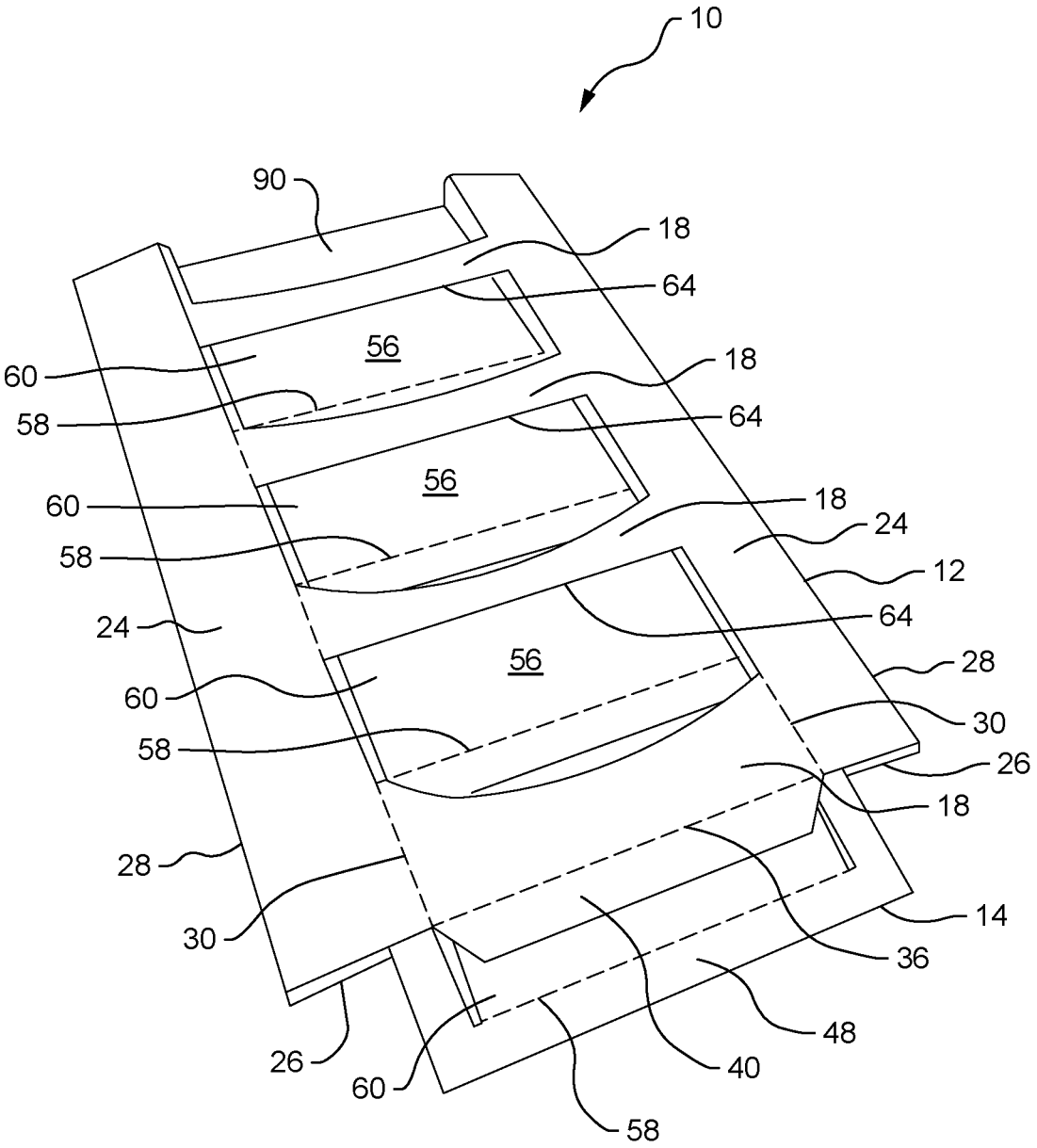

FIG. 10 is a front perspective view of the pre-assembled hutch 10 shown in its "flat" condition prior to final assembly (set up). The hutch 10 is substantially flat. Each front sidewall panel 24 is in substantially flat abutting relationship with a corresponding rear sidewall panel 26. The spine 14 is folded in half and sandwiched between the front sidewall panels 24 and the rear sidewall panels 26.

Final Assembly (Set Up)

Figure 11:
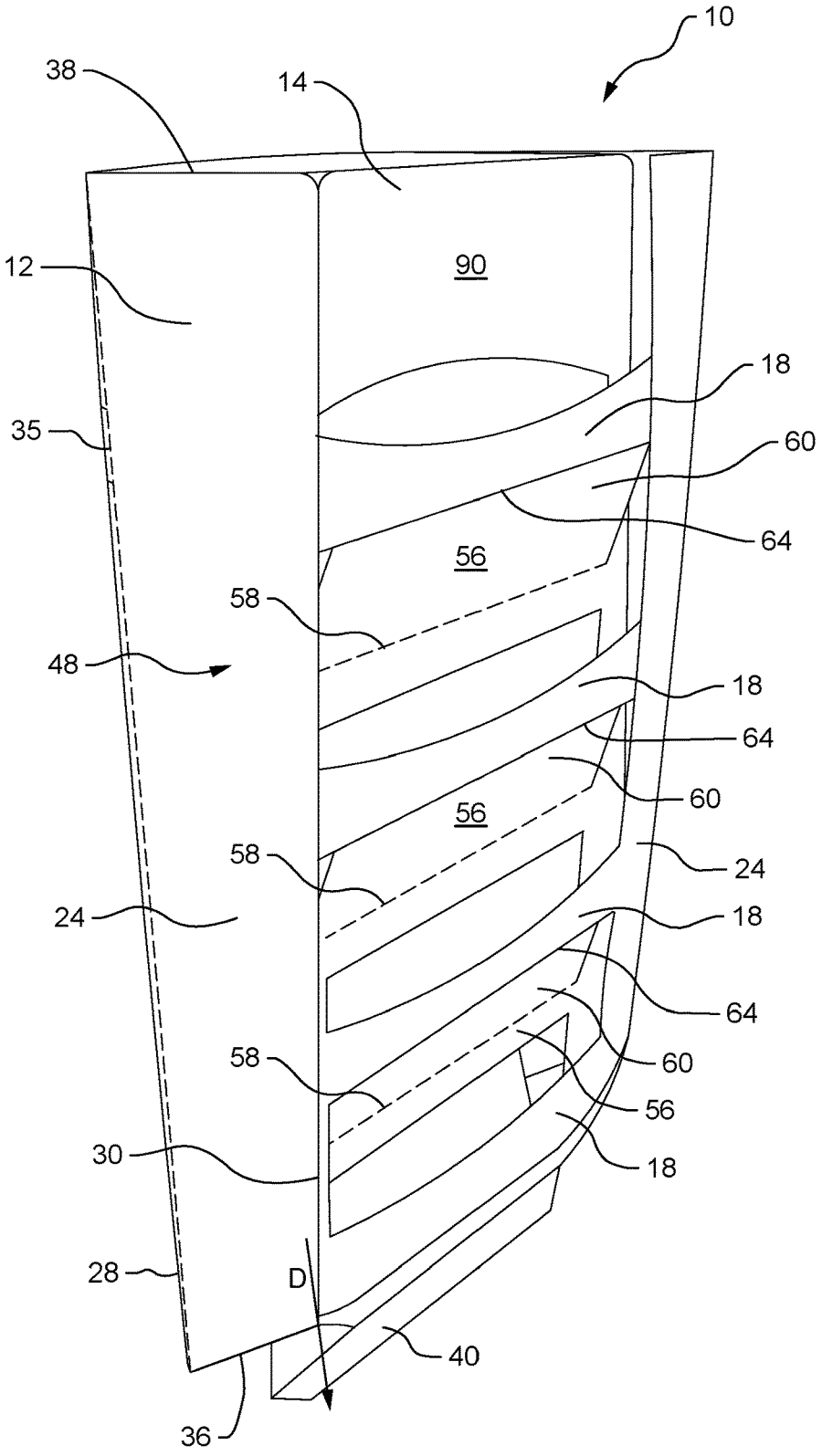
FIG. 11 is a front perspective view showing the hutch of FIG. 10 during final set up.

The hutch 10 can be easily set up on-site by a single person by pushing down on the body 12 with one hand in the direction indicated by arrow D in FIG. 11 while holding the spine 14 upright with the other hand. Because the front shelf flaps 56 are glued to the front panels 18 of the body 12, and the rear shelf flaps 76 are glued to the rear wall half panels 22, when the body 12 is pushed downwardly relative to the spine 14, the shelf flaps 56, 76 will rotate along their respective front shelf flap fold lines 58 and rear shelf flap fold lines 78 and splay outwardly, away from each other, until they form the horizontal shelves 44 shown in FIG. 1. More specifically, as the body 12 moves downward relative to the spine 14, the front shelf flaps 56 rotate forward about front shelf flap fold lines 58 and lock into a horizontal position while the rear shelf flaps 76 rotate rearward about rear shelf flap fold lines 78 and lock into the same horizontal plane as the front shelf flaps 56, creating the shelves 44 shown in FIG. 1. Each pair of front and back sidewall panels 24, 26, which lay almost flat against each other prior to set up, will fan out along sidewall fold line 28 to form an angle. As the body 12 reaches its final position relative to the spine 14, the tabs 88 extending laterally from the spine 14 may fit into the slots 35 in the body 12 to further stabilize the hutch 10. The integrated header board 90 may emerge above the body 12. Finally, the bottom flaps 40, 41 may be folded inwardly to help stabilize the base 36.

The assembled hutch 10 forms a three-dimensional display having a width equal to the width of the front panels 18 and a depth equal to the depth of the sidewalls 20.

INDUSTRIAL APPLICABILITY

The hutch described herein can be used in retail or other settings for the display and sale of any suitable items, including salty snacks, cookies and household goods.

It should be understood that the embodiments described above are only particular examples which serve to illustrate the principles of the invention. Modifications and alternative embodiments are contemplated which do not depart from the scope of this disclosure as defined by the foregoing teachings and appended claims. It is intended that the claims cover all such modifications and alternative embodiments that fall within their scope.

The invention claimed is:

1. A hutch comprising:

a body made entirely from a folded first blank and comprising two sidewalls, each sidewall comprising a front vertical edge and a rear vertical edge, a rear wall extending between the rear vertical edge of each of the sidewalls, and one or more horizontally oriented front panels, each front panel extending between the front vertical edge of each of the sidewalls; and a spine made entirely from a folded second blank, the spine comprising a spine front panel and a spine rear panel integrally connected by a vertical spine fold line and folded together to form a frame and shelves hingedly attached to the frame, each of the shelves being hingedly attached to one of the horizontally oriented front panels and to the rear wall; wherein the spine frame is slidable in a vertical direction with respect to the body during assembly of the hutch.

2. The hutch of claim 1 wherein:

the spine front panel comprises a front frame and one or more front shelf flaps, each of the front shelf flaps being hingedly attached to the front frame and hingedly attached to one of the horizontally oriented front panels; and the spine rear panel comprises a rear frame and one or more rear shelf flaps, each of the rear shelf flaps being hingedly attached to the rear frame and hingedly attached to the rear wall.

3. The hutch of claim 2 wherein:

each front shelf flap comprises a front shelf panel and a front facing panel, each front shelf panel is hingedly and rotatably attached to the front frame, and each front facing panel is hingedly connected to a front shelf panel and also to one of the horizontally oriented front panels; and each rear shelf flap comprises a rear shelf panel and a rear facing panel, each rear shelf panel is hingedly and rotatably attached to the rear frame, and each rear facing panel is hingedly connected to a rear shelf panel and also to the rear wall.

4. The hutch of claim 3 wherein the hutch is convertible between a first, flat position in which the front shelf panel and the rear shelf panel of each shelf are positioned in substantially flat, abutting relationship, and a second, display position in which the front shelf panel and rear shelf panel of each shelf form a substantially planar load supporting shelf bottom.

5. The hutch of claim 4 wherein:

the horizontally oriented front panels have a width and the sidewalls have a depth; and in the second, display position the hutch forms a three-dimensional display having a width equal to the width of the horizontally oriented front panels and a depth equal to the depth of the sidewalls.

6. The hutch of claim 5 wherein:

the rear wall comprises two rear wall half panels, each rear wall half panel hingedly connected to one of the sidewalls.

7. The hutch of claim 2 wherein:

as the spine frame moves vertically with respect to the body, the front shelf flaps rotate forward about front shelf flap fold lines and lock into a horizontal plane while the rear shelf flaps rotate rearward about rear shelf flap fold lines and lock into the same horizontal plane as the front shelf flaps.

8. The hutch of claim 7 wherein:

as the spine frame moves vertically with respect to the body, tabs extending laterally from the spine fit into slots defined by the body.

9. The hutch of claim 1 wherein:

each horizontally oriented front panel extends between and is connected at either end to the sidewalls along left and right vertical front fold lines.

10. The hutch of claim 1 wherein:

each blank is made of corrugated board.

11. The hutch of claim 1 wherein:

the spine frame is configured to move parallel to the sidewall front vertical edges and sidewall rear vertical edges independently of the body.

12. A hutch comprising:

a body made from a folded first blank and comprising two sidewalls, each sidewall comprising a front vertical edge and a rear vertical edge, a rear wall extending between the rear vertical edge of each of the sidewalls, and one or more horizontally oriented front panels, each front panel extending between the front vertical edge of each of the sidewalls; and a spine made entirely from a folded second blank, the spine comprising a spine front panel and a spine rear panel integrally connected by a vertical spine fold line and folded together to form a frame and shelves hingedly attached to the frame, each of the shelves being hingedly attached to one of the horizontally oriented front panels and to the rear wall; wherein the body is slidable in a vertical direction with respect to the spine during assembly of the hutch.

13. The hutch of claim 12 wherein:

the spine front panel comprises a front frame and one or more front shelf flaps hingedly attached to the front frame; and the spine rear panel comprises a rear frame and one or more rear shelf flaps hingedly attached to the rear frame.

14. The hutch of claim 13 wherein:

the hutch is convertible between a first, flat position in which the one or more front shelf flaps and the one or more rear shelf flaps are positioned in substantially flat, abutting relationship, and a second, display position in which the one or more front shelf flaps and the one or more rear shelf flaps form substantially planar load supporting shelf bottoms.

15. The hutch of claim 14 wherein:

to convert the hutch from the first position to the second, display position, the body is pushed downwardly relative to the spine.

* * * * *